US009121632B2

(12) United States Patent
Muller

(10) Patent No.: US 9,121,632 B2
(45) Date of Patent: Sep. 1, 2015

(54) METHOD OF MAKING PIECES OF ICE AND AN ICE DISPENSING DEVICE

(75) Inventor: Johannes Cornelius Antonius Muller, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 843 days.

(21) Appl. No.: 12/739,418

(22) PCT Filed: Oct. 23, 2008

(86) PCT No.: PCT/IB2008/054368

§ 371 (c)(1),
(2), (4) Date: Apr. 23, 2010

(87) PCT Pub. No.: WO2009/057017

PCT Pub. Date: May 7, 2009

(65) Prior Publication Data

US 2010/0257874 A1 Oct. 14, 2010

(30) Foreign Application Priority Data

Nov. 2, 2007 (EP) ..... 07119885

(51) Int. Cl.
*F25C 5/12* (2006.01)
*F25C 1/10* (2006.01)
*F25C 1/14* (2006.01)

(52) U.S. Cl.
CPC ... *F25C 5/12* (2013.01); *F25C 1/10* (2013.01); *F25C 1/145* (2013.01)

(58) Field of Classification Search
CPC ..... F25C 1/10; F25C 5/12; F25C 1/145
USPC ..... 62/320, 345, 346, 71, 66; 241/DIG. 17; 222/80
See application file for complete search history.

(56) References Cited

U.S. PATENT DOCUMENTS

| | | | | | |
|---|---|---|---|---|---|
| 380,177 | A | * | 3/1888 | Brown | 241/92 |
| 1,722,031 | A | * | 7/1929 | Bert | 241/92 |
| 1,779,341 | A | * | 10/1930 | Stieber | 62/320 |
| 1,992,783 | A | * | 2/1935 | Smith | 241/92 |
| 2,122,947 | A | * | 7/1938 | Lopez | 62/320 |
| 2,191,756 | A | * | 2/1940 | Gray | 241/92 |
| 2,453,140 | A | * | 11/1948 | Kubaugh | 241/92 |
| 2,477,474 | A | * | 7/1949 | Samuel | 241/92 |
| 2,655,318 | A | * | 10/1953 | Beyer | 241/92 |
| 2,751,118 | A | * | 6/1956 | Soule | 222/80 |
| 2,757,909 | A | * | 8/1956 | Wayne | 241/282.2 |
| 2,853,243 | A | * | 9/1958 | Samuel | 241/92 |
| 3,274,792 | A | * | 9/1966 | Weil et al. | 62/138 |
| 3,470,783 | A | * | 10/1969 | Tallving | 83/672 |
| 3,552,663 | A | * | 1/1971 | Royals | 241/92 |
| 3,984,996 | A | * | 10/1976 | Bright | 62/353 |

(Continued)

FOREIGN PATENT DOCUMENTS

| | | | |
|---|---|---|---|
| EP | 1710520 | A2 | 10/2006 |
| GB | 695696 | A | 8/1953 |

*Primary Examiner* — Frantz Jules
*Assistant Examiner* — Emmanuel Duke

(57) ABSTRACT

A method and a device for making pieces of ice where water in a container is frozen into ice. A helically threaded shaft extends through the container so that the ice surrounds the shaft and is engaged by the helical thread of the shaft. The threaded shaft is rotated with respect to the ice so that the ice is moved toward a cutting member carried by the threaded shaft. Subsequently, the ice is shaved by the cutting member.

21 Claims, 5 Drawing Sheets

(56) References Cited

U.S. PATENT DOCUMENTS

| | | | | | |
|---|---|---|---|---|---|
| 4,113,190 | A | * | 9/1978 | Fudman | 241/92 |
| 4,123,918 | A | * | 11/1978 | Kohl et al. | 62/320 |
| 4,484,455 | A | * | 11/1984 | Hida | 62/320 |
| 4,569,266 | A | * | 2/1986 | Ando | 83/411.1 |
| 4,621,968 | A | | 11/1986 | Hutchinson | |
| 4,681,030 | A | * | 7/1987 | Herbert | 99/484 |
| 4,718,610 | A | * | 1/1988 | Gallaher | 241/37.5 |
| 4,796,784 | A | * | 1/1989 | Spirk et al. | 222/80 |
| 4,998,677 | A | * | 3/1991 | Gallaher | 241/95 |
| 5,191,772 | A | * | 3/1993 | Engel | 62/320 |
| 5,325,682 | A | * | 7/1994 | Chiang | 62/320 |
| 5,402,949 | A | * | 4/1995 | Berner et al. | 241/101.2 |
| 5,513,810 | A | * | 5/1996 | Lin | 241/95 |
| 5,620,115 | A | * | 4/1997 | McGill | 222/95 |
| 6,012,660 | A | * | 1/2000 | Colman | 241/30 |
| 6,082,121 | A | * | 7/2000 | Marsh et al. | 62/75 |
| 6,389,836 | B1 | * | 5/2002 | Markin et al. | 62/320 |
| 2002/0007638 | A1 | * | 1/2002 | Tchougounov et al. | 62/71 |
| 2004/0104251 | A1 | | 6/2004 | Baumann | |
| 2005/0132901 | A1 | * | 6/2005 | Ball | 99/455 |
| 2005/0158427 | A1 | * | 7/2005 | Palmer et al. | 426/89 |
| 2006/0210686 | A1 | * | 9/2006 | Lebowitz | 426/515 |
| 2010/0257874 | A1 | | 10/2010 | Muller | |

* cited by examiner

METHOD OF MAKING PIECES OF ICE AND AN ICE DISPENSING DEVICE

FIELD OF THE INVENTION

The invention is related to a method of making pieces of ice, in which method water in a container is frozen into ice, and a helically threaded shaft extends through the container, so that ice surrounds the shaft and is engaged by the helical thread of the shaft, the threaded shaft and/or the ice being rotated with respect to each other, so that the ice is moved in axial direction with respect to the shaft.

BACKGROUND OF THE INVENTION

Such a method is disclosed in U.S. Pat. No. 3,984,996. This publication describes an ice dispensing device, in which a lump of ice is present in a tube-like container having a square cross-section. A threaded shaft extends in axial direction through the ice and the ice is moved through the container in said axial direction by rotating the threaded shaft. At the end of the tube-like container there is an ice cutting member, cutting uniform pieces of ice from the forward moving lump of ice (column of ice).

The pieces of ice can be put in a drink in order to cool the drink. The quantity of the dispensed ice is limited to one of the uniform pieces of ice or a certain number of such pieces of ice. It is not possible to add a different, desired quantity to the drink. Furthermore, it may be desired to cool down the drink in a short time, and therefore the outer surface of the pieces of ice has to be relatively large with respect to the content of the dispensed pieces of ice.

A disadvantage of the device disclosed in U.S. Pat. No. 3,984,996 is that only pieces of ice having the same predetermined content can be produced, so that it is not possible to dispense any desired quantity of ice, for example a very small quantity. Furthermore, the dispensed pieces of ice are blocks, having a relatively large content with respect to their outer surface, so that the pieces of ice will melt in a relative long period of time.

In particular, the ice dispensing device according to the invention is a domestic apparatus for delivering pieces of ice for many applications. The dispensed ice can be used for preparing food or for cooling objects or for adding ice to drinks.

SUMMARY OF THE INVENTION

An object of the invention is to provide a method and a device for making and dispensing pieces of ice, wherein a threaded shaft moves through a lump of ice by rotation with respect to the ice in order to move the ice toward an ice cutting member, enabling any quantity of ice to be dispensed, including very small quantities.

Another object of the invention is to provide a method and a device for making and dispensing pieces of ice, wherein a threaded shaft moves through a lump of ice by rotation with respect to the ice in order to move the ice toward an ice cutting member, enabling the dispensed pieces of ice to have a large outer surface with respect to their content.

To accomplish one or both of these objects, the threaded shaft carries the cutting member being located at the surface of the ice, so that the ice and the cutting member move toward each other by rotating the threaded shaft with respect to the ice, whereby the ice is shaved by the cutting member. Thereby relatively thin pieces of ice (slices of ice) are removed from the lump of ice, having a relatively large outer surface with respect to their content. Furthermore, the quantity of shaved ice is proportional to the angle of rotation of the threaded shaft, and therefore the dispensed ice can be dispensed exactly in any desired quantity, including in a very small quantity.

The cutting member can be permanently fixed to the threaded shaft, but the cutting member can also be removably fixed to the shaft. The helical thread of the shaft can be a single helical thread, but it can also be a double helical thread, or there can be more threads, in other to increase the pitch of the thread, i.e. the distance over which the ice is moved with respect to the shaft by each revolution of the shaft.

In a preferred embodiment, the threaded shaft is mounted in the container having a side wall of which an inner surface extends parallel to the axis of the threaded shaft, the threaded shaft being rotated with respect to the container after the water has frozen into ice, so that the ice moves in the container in the axial direction of the shaft, the ice being prevented from rotating in the container by a non-circular shape of the inner surface of the wall of the container in a cross-section of said inner wall perpendicular to the axial direction. The cross-sectional shape of the inner surface of the side wall of the container may be square or may have any other non-circular shape, but preferably it has a substantially circular shape and comprises one or more ridges, or ribs, in axial direction.

In a preferred embodiment, the container comprising the threaded shaft is placed, after it has been filled with water, in a freezer, for example a domestic freezer, so that the water in the container freezes into ice, after which the container is attached to a structure having an electric motor, which electric motor rotationally drives the threaded shaft, and the shaved ice is guided to ice delivery means of the device. In particular, an electric motor is applied, allowing the angle of rotation of the output shaft to be controlled. The ice dispensing device does not need to comprise cooling means, which is an advantage, in particular for a domestic apparatus. The container can be insulated with heat insulating material and the device may comprise a relatively small cooling device such as a Peltier element in order to keep the ice frozen. In another preferred embodiment, the ice dispensing device does not comprise powered cooling means, in which case the container is placed back in the freezer after use, so that the ice in the container is kept frozen.

Preferably, the container comprises a bottom and is attached substantially upside down to the structure with the electric motor, the cutting member being located at the lower side of the container. When the container is filled with water and placed in the freezer in upright position, the cutting member can be removed and the container can be closed with a cover. Preferably, the cutting member covers the major part of the upper side of the container and is provided with an opening, so that water can flow through the opening into the container. In addition, the container can be placed in the freezer without an additional removable cover, and the cutting member can be permanently fixed to the threaded shaft.

The invention is also related to an ice dispensing device for delivering pieces of ice, comprising a cutting member and a container for containing ice, a rotating threaded shaft extending in axial direction through the space inside the container, and the container having a surrounding side wall having an inner surface extending substantially parallel to the axial direction of the container, said inner surface having a non-circular cross-section perpendicular to said axial direction, and the threaded shaft carrying the cutting member for shaving ice from the surface of the ice around the threaded shaft. Preferably, the inner surface of the side wall of the container is exactly parallel to the axial direction, but in another preferred embodiment, the inner surface of the side wall of the container diverges a little in the direction of the cutting member, preferably less than 0.1 cm over its axial length. Thereby, the movability of the ice toward the cutting member can be improved.

The cutting member may be shaped like a knife having a substantially radial cutting edge extending from the threaded shaft to the side wall of the container. The cutting edge of the knife rests against the surface of the ice, and may be positioned at an angle with respect to said surface. Furthermore, the cutting member may have a number of cutting edges at different locations of the cutting member. However, in a preferred embodiment, the cutting member is a substantially disk-like element having a substantially straight cutting edge extending in a substantially radial direction with respect to the threaded shaft, the surface of the cutting member facing the ice being helically shaped corresponding to the helical shape of the thread of the shaft. The expression "disk-like" means substantially flat and round. The cutting member covers a substantial part of the opening of the container, and may have an opening for filling the container with water.

The inner wall of the container may have any cross-sectional shape, but in a preferred embodiment, the inner surface of the side wall of the container is substantially cylindrical and comprises one or more inwardly extending axial ridges, so that the ice inside the container is prevented from rotating by the axially extending ridges or ribs.

The ice dispensing device may comprise the described container and a handle that is, or can be, connected to the threaded shaft in order to rotate that shaft by hand. The whole ice dispensing device can be placed in a freezer for freezing the water into ice and/or to keep its temperature low, and the handle for rotating the threaded shaft can be removed from the device, or can be permanently fixed to the threaded shaft.

In a preferred embodiment, the device comprises an electric motor for driving the threaded shaft, the container including the threaded shaft with the cutting member being removable from the part of the device comprising the electric motor, so that it can be filled with water and placed in a freezer separated from the remaining part of the ice dispensing device. In addition, the drive shaft of the electric motor is disconnectably coupled with the threaded shaft in the container.

In a preferred embodiment, the container has a bottom wall at its lower side opposite to its upper side where the cutting member is located, the threaded shaft is rotatably fixed in said lower wall, and the container, after the water in it is frozen, can be placed upside down in the ice dispensing device. Upside down includes an inclined position of the container, i.e. that the axial direction of the container deviates from the vertical direction.

Preferably, the bottom wall is provided with a valve in order to supply air into the container when the ice moves away from the bottom of the container by means of the rotating threaded shaft. By virtue thereof, the movability of the ice in the container is improved.

In a preferred embodiment, the material of the threaded shaft is flexible, so that the portion of the shaft near the end where it is driven can rotate with respect to a portion further away from said end when the shaft is being driven. As a result, the rotational drive force is relatively low when the ice sticks to the material of the threaded shaft. The flexible material of the shaft can be plastic, for example polypropylene.

BRIEF DESCRIPTION OF THE DRAWINGS

The invention will now be further elucidated by means of a description of an embodiment of a domestic ice dispensing device, which comprises a rotating threaded shaft extending in axial direction through the space inside a container, said threaded shaft carrying a cutting member for shaving ice from the surface of the ice around the threaded shaft, and reference being made to the drawing comprising diagrammatic figures, in which.

The figures are very schematic representations, only showing parts that contribute to the elucidation of the described embodiment of the invention.

DETAILED DESCRIPTION OF SOME EMBODIMENTS OF THE INVENTION

Figure 1:
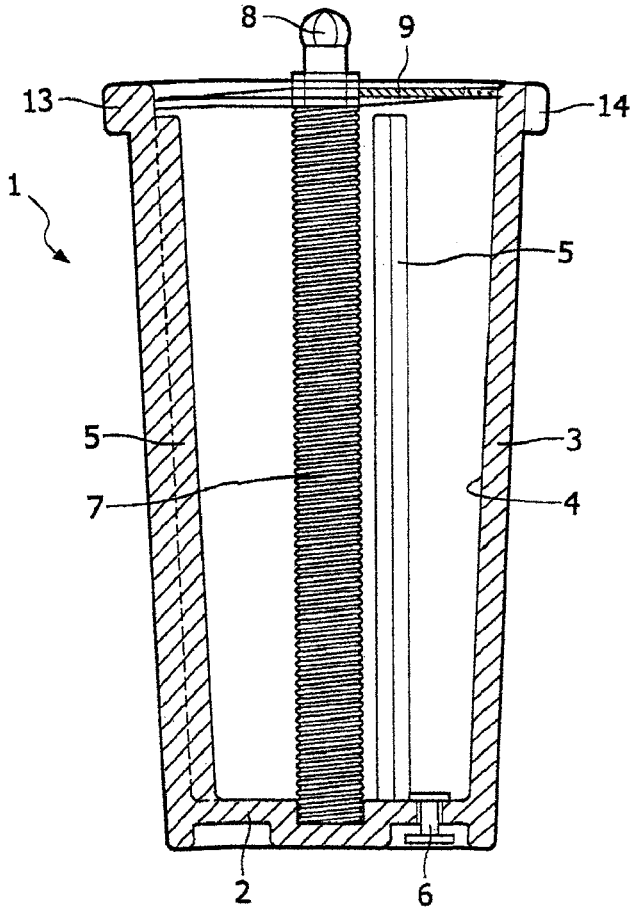
FIGS. 1 and 1A are sectional views of the container according to different embodiments.
Figure 1A:
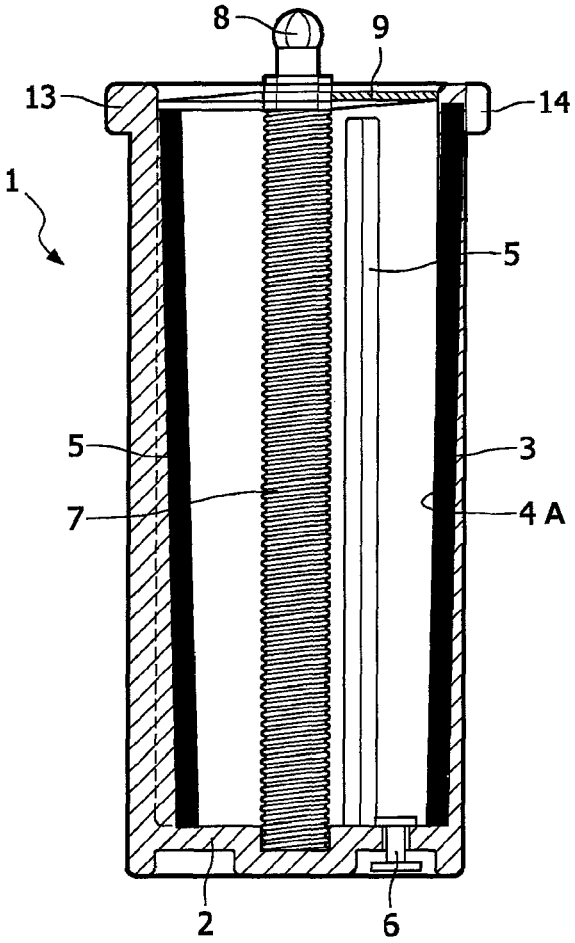

FIG. 1 shows a container 1, for example, made of molded plastic material such as polypropylene, and includes a bottom wall 2. The side wall 3 of the container 1 has a cylindrical inner surface 4. In an embodiment shown in FIG. 1A, the inner surface 4A of the side wall 3 of the container 1 diverges a little in the direction of the cutting member, preferably less than 0.1 cm over its axial length. Thereby, the movability of the ice toward the cutting member can be improved. The side wall 3 comprises three ridges 5 extending in axial direction in the container 1. The bottom wall 2 comprises a valve having a valve body 6 that can freely move in axial direction (vertical direction in FIG. 1). In FIG. 1, the valve 6 is represented in closed position. Inside the container 1 is a threaded shaft 7 extending in axial direction and supported in a central blind bore in the bottom wall 2. The threaded shaft 7 with the cutting member 9 can be removed from the container 2 in order to fill the container with water. Furthermore, the separated parts can easily be cleaned.

Figure 5:
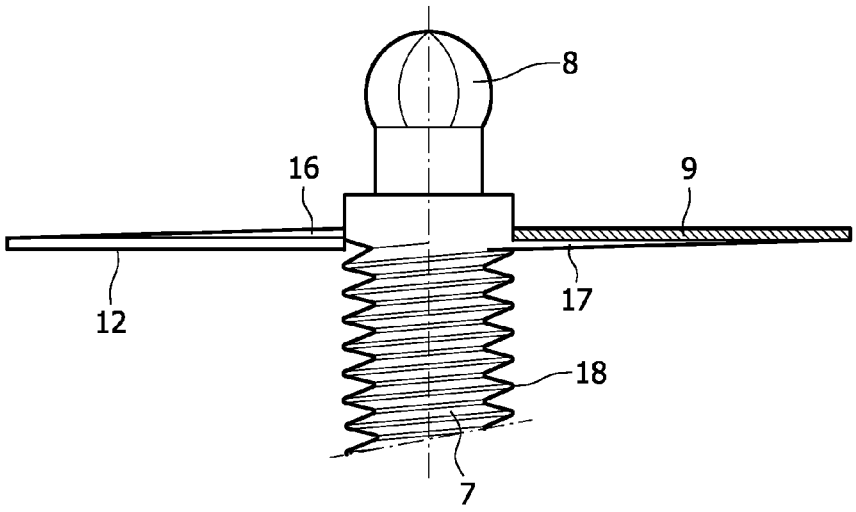
FIG. 5 shows the cutting member in more detail.

The threaded shaft 7 comprises at its upper end in FIG. 1 a hexagonal coupling member 8 in order to be engageable by drive means for rotating the threaded shaft 7. The threaded shaft 7 carries a cutting member 9 near its upper end in FIG. 1. The cutting member 9 will be described in more detail hereinafter and is represented in FIG. 5 in more detail. The container 1 as shown in FIG. 1 can be filled with water and placed in a freezer, so that the water is frozen into ice. After the water is frozen, the column or lump of ice 10 in the container 1 can be moved in axial direction by rotating the threaded shaft 7. The helical thread of shaft 7 may have any appropriate shape.

Figure 2:
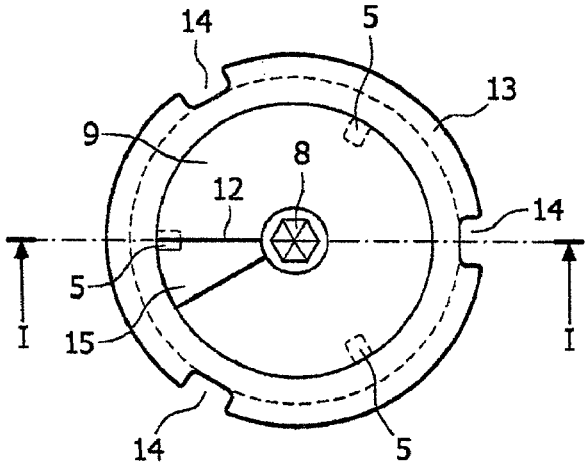
FIG. 2 is a top view of the container represented in FIG. 1.
Figure 3:
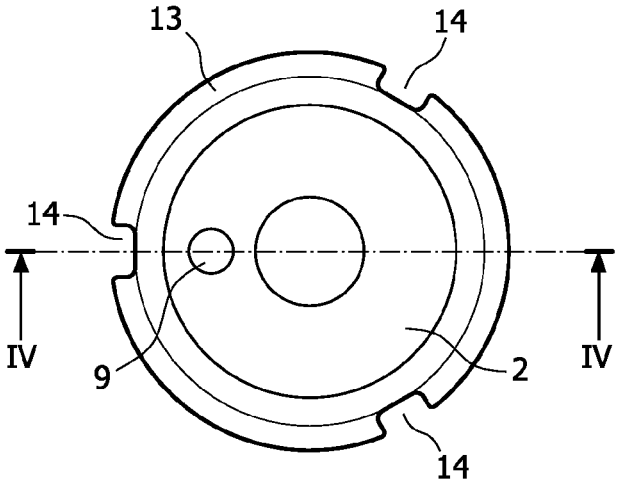
FIG. 3 is a bottom view of the container represented in FIG. 1.
Figure 4:
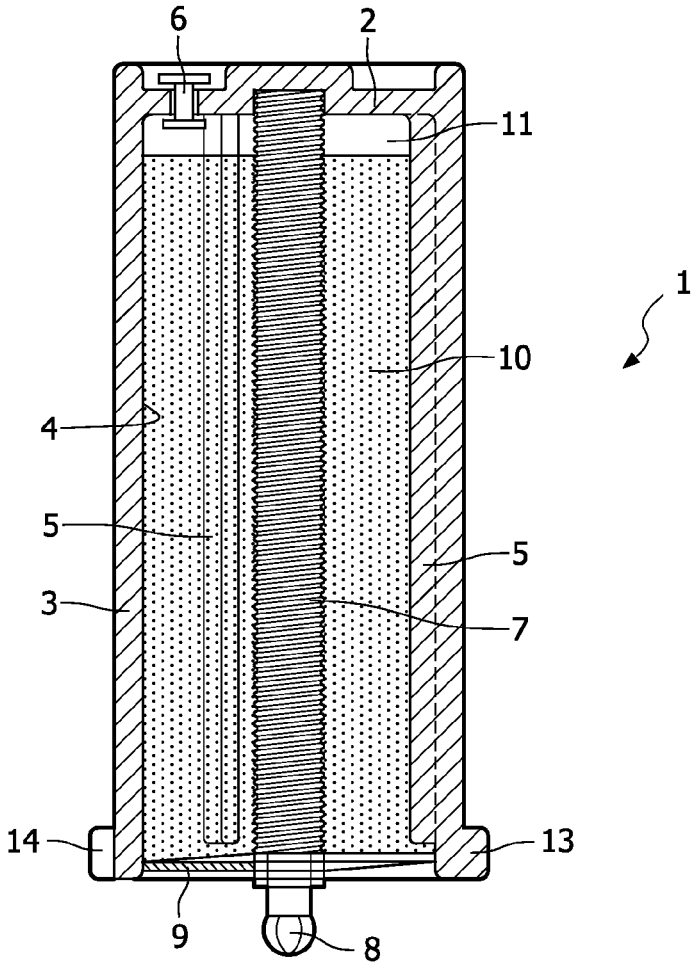
FIG. 4 is a sectional view of the container in upside down position.

FIG. 2 shows the upper side of the container 1 as represented in FIG. 1, and the lower side of its representation in FIG. 4. The sectional view of FIG. 1 is indicated with the arrows I in FIG. 2. The cutting member 9 is substantially flat and disk-like, and its surface directed to the inner space of the container 1 is helical around the threaded shaft 7, corresponding to the helical thread of the shaft 7. The cutting member 9 has a straight cutting edge 12 extending in radial direction with respect to the threaded shaft 7. By rotating the threaded shaft 7, the ice 10 is moved toward the cutting member 9 (downward in FIG. 4), while the cutting edge 12 shaves pieces of ice from the surface of the ice 10. FIG. 3 shows the lower side of the container 1 as represented in FIG. 1, and the upper side of its representation in FIG. 4. The sectional view of FIG. 1 is indicated with the arrows I in FIG. 3.

FIG. 4 shows the container in upside down position containing a column of ice 10 that is moved downward away from the bottom 2 by rotating the shaft 7. Valve 6 is open (shifted downward in FIG. 2), so that air can flow into the space 11 between the bottom wall 2 and the ice 10. By rotating the threaded shaft 7, the ice is pressed against the cutting member 9, which cutting member 9 shaves pieces or slices of ice from the lower surface of the ice 10.

The cylindrical side wall 3 of the container 1 is provided with a collar 13 at its upper end. The collar 13 can be engaged by corresponding fixation means of the ice dispensing device, such that parts of the fixation means can pass through the three recesses 14 of the collar 13. In front of the cutting edge 12 is an opening 15 having a substantially triangular shape. Through this opening 15 the container 1 can be filled with water when the container 1 is in the upright position, as is shown in FIG. 1.

FIG. 5 shows the cutting member 9, as it is represented in FIG. 1, in more detail. The threaded shaft 7 and the hexagonal coupling member 8 are represented in a side view, while the cutting member 9 is represented in a sectional view. The cutting member 9 extends substantially radially to the threaded shaft 7. The upper side 16 and the lower side 17 of the cutting member 9 are curved helically, corresponding to the helical shape of the thread 18 of the threaded shaft 7. The cutting edge 12 borders the lower side 17 of the cutting member 9 and can be shaped by an angle of 90° or can be shaped like an acute-angled material portion of the cutting member 9.

In the described embodiment, the cutting member 9 is attached to the threaded shaft 7 by a welding operation, by clamping, or by means of a glue. However, any fixation means is possible whereby the cutting member 9 can be permanently fixed to the threaded shaft 7 or whereby the cutting member 9 is removable from the threaded shaft 7. In the described embodiment, the shaft 7 is provided with a single helical thread, but it can also be a double helical thread, or there can be more threads in order to increase the pitch of the thread. The displacement of the lump of ice 10 in the container 1 per revolution of the threaded shaft 7 is proportional to the pitch of the thread of the shaft 7.

Figure 6:
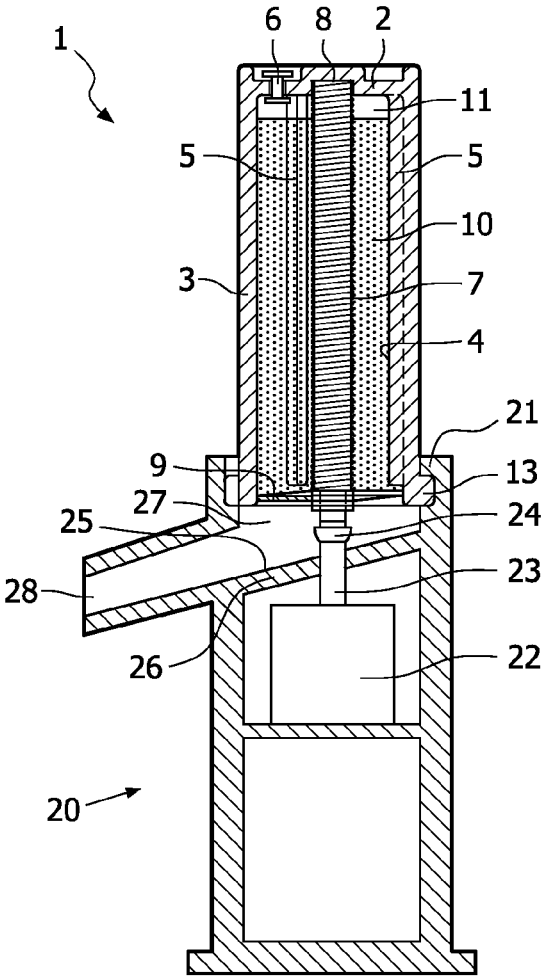
FIG. 6 is a sectional view of the described embodiment.
Figure 7:
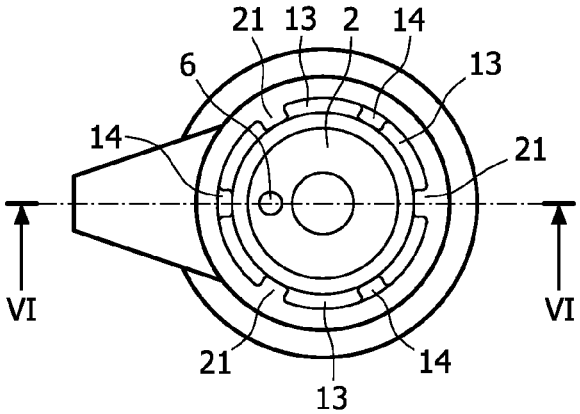
FIG. 7 is a top view of the device represented in FIG. 6.

FIG. 6 shows the ice dispensing device in a sectional view taken on the line indicated with the arrows VI in FIG. 7. FIG. 7 is a top view of the device represented in FIG. 6. The device comprises the part 20 and the container 1, which container 1 is represented in FIGS. 1 and 4. The container 1 is attached upside down (as represented in FIG. 4) onto the part 20, such that the collar 13 of the container 1 is engaged by three engagement members 21 at the higher edge of part 20. The container 1 can be separated from the part 20 by rotating the container 1, so that the recesses 14 in the collar 13 correspond with the engagement members 21. Means for preventing the container 1 from rotating during the ice dispensing operation are present, but not represented in the figures.

The parts of the container 1 are indicated with the same reference numerals as used in the FIGS. 1-5. The part 20 comprises an electric motor 22 having a drive shaft 23 carrying a coupling member 24 at its end. The coupling member 24 engages the corresponding hexagonal coupling member 8 (see FIG. 4) of the threaded shaft 7, so that the electric motor 22 drives, through its drive shaft 23, the threaded shaft 7. Thereby, the lump of ice 10 is shaved by the rotating cutting member 9 and falls down on the inclined surface 25 of the lower wall 26 of the ice receiving chamber 27. The drive shaft 23 of the electric motor 22 passes through an opening in said lower wall 26. The shaved pieces of ice slide over the inclined surface 25 to the ice dispensing opening 28 of the device. A glass with a drink can be put under the ice dispensing opening 28 in order to add ice to the drink.

The described embodiment of the domestic ice dispensing device is only an example of a device according to the invention; many other embodiments are possible.

The invention claimed is:

1. A method of making pieces of ice comprising the acts of:

freezing water in a container into ice, wherein the container has an inner surface and an axial length from a first end of the container to a second end of the container;

rotating a helically threaded shaft that extends through the container, wherein the ice surrounds and contacts the shaft and is engaged by a helical thread of the shaft for moving the ice in an axial direction with respect to the shaft toward a cutting member due to rotation of the helical thread that contacts the ice, wherein the shaft carries the cutting member being located at a surface of the ice that moves towards the cutting member by the rotating act; and shaving the ice by the cutting member, wherein the inner surface of the container diverges over the axial length of the container along a direction of the cutting member to improve movability of the ice toward the cutting member.

2. The method as claimed in claim 1, wherein the threaded shaft is mounted in the container, wherein the inner surface is square-shaped and extends parallel to an axis of the threaded shaft, the threaded shaft being rotated with respect to the container after the water is frozen into ice so that the ice moves in the container in the axial direction, the ice being prevented from rotating in the container by the square-shaped inner surface.

3. The method of claim 1, wherein the container has a square-shaped inner surface.

4. The method of claim 1, wherein the inner surface of the container comprises three equally spaced inwardly extending axial ridges.

5. The method of claim 1, wherein the cutting member is a disk-like element having a straight cutting edge extending in a radial direction with respect to the threaded shaft, a surface of the cutting member facing the ice being curved helically to correspond to a helical shape of the thread of the shaft, and wherein the cutting member has an opening in front of the cutting edge, the opening having a triangular shape.

6. The method of claim 1, wherein the inner surface of the container diverges over the axial length of the container along a direction of the cutting member by less than 0.1 cm.

7. A method of making pieces of ice comprising the acts of:

freezing water in a container into ice, wherein the container has an inner surface and an axial length from a first end of the container to a second end of the container;

rotating a helically threaded shaft that extends through the container, wherein the ice surrounds and contacts the shaft and is engaged by a helical thread of the shaft for moving the ice in an axial direction with respect to the shaft toward a cutting member due to rotation of the helical thread that contacts the ice, wherein the threaded shaft carries the cutting member being located at a surface of the ice that moves towards the cutting member by the rotating act;

shaving the ice by the cutting member;

placing the container in a freezer after the container has been filled with water so that the water in the container freezes into ice;

attaching the container to a structure having an electric motor, wherein the electric motor rotationally drives the threaded shaft; and guiding the shaved ice to an ice delivery opening, wherein the inner surface of the container diverges over an axial length of the container along a direction of the cutting member to improve movability of the ice toward the cutting member.

8. The method as claimed in claim 7, wherein the container comprises a bottom at the first end and is attached substantially upside down to said structure with the electric motor, the cutting member being located at a lower side at the second end of the container.

9. The method of claim 7, wherein the cutting member is a disk-like element having a straight cutting edge extending in a radial direction with respect to the threaded shaft, a surface of the cutting member facing the ice being curved helically to correspond to a helical shape of the thread of the shaft, and wherein the cutting member has an opening in front of the cutting edge, the opening having a triangular shape.

10. An ice dispensing device for delivering pieces of ice comprising;

a cutting member;

a container for containing ice and having an axial length from a first end of the container to a second end of the container; and a rotating threaded shaft extending in an axial direction through a space inside the container for contacting the ice by a helical thread of the threaded shaft and moving the ice in the axial direction due to rotation of the helical thread that contacts the ice, wherein the container has a surrounding side wall having an inner surface extending substantially parallel to the axial direction of the container between the first end and the second end of the container, and wherein the threaded shaft carries the cutting member for shaving the ice from a surface of the ice around the threaded shaft, wherein the inner surface of the surrounding side wall of the container diverges over an axial length of the container along a direction of the cutting member to improve movability of the ice toward the cutting member.

11. The ice dispensing device as claimed in claim 10, wherein the cutting member is a disk-like element having a straight cutting edge extending in a radial direction with respect to the threaded shaft, a surface of the cutting member facing the ice being curved helically to correspond to a helical shape of the thread of the shaft, and wherein the cutting member has an opening in front of the cutting edge, the opening having a triangular shape.

12. The ice dispensing device as claimed in claim 10, wherein material of the threaded shaft is flexible, so that a portion of the shaft near an end of the shaft where the shaft is driven can rotate with respect to a portion further away from said end.

13. The ice dispensing device of claim 10, wherein said inner surface has a square cross-section perpendicular to said axial direction.

14. An ice dispensing device for delivering pieces of ice comprising:

a cutting member;

a container for containing ice and having an axial length from a first end of the container to a second end of the container;

a rotating threaded shaft extending in an axial direction through a space inside the container for contacting the ice by a helical thread of the threaded shaft and moving the ice in the axial direction due to rotation of the helical thread that contacts the ice;

a housing comprising an electric motor for driving the threaded shaft;

wherein the container has a surrounding side wall having an inner surface extending substantially parallel to the axial direction of the container between the first end and the second end of the container, and wherein the threaded shaft carries the cutting member for shaving the ice from a surface of the ice around the threaded shaft, wherein the container including the threaded shaft with the cutting member is removable from the housing comprising the electric motor, and wherein the inner surface of the surrounding side wall of the container diverges over an axial length of the container along a direction of the cutting member to improve movability of the ice toward the cutting member.

15. The ice dispensing device of claim 14, wherein said inner surface has a non-circular cross-section perpendicular to said axial direction.

16. The ice dispensing device of claim 14, further comprising an inclined surface for delivering shaved ice from the container shaved by the cutting member, wherein the inclined surface intersects an axis passing through the cutting member and the motor.

17. The ice dispensing device of claim 14, wherein the cutting member is a disk-like element having a straight cutting edge extending in a radial direction with respect to the threaded shaft, a surface of the cutting member facing the ice being curved helically to correspond to a helical shape of the thread of the shaft, and wherein the cutting member has an opening in front of the cutting edge, the opening having a triangular shape.

18. An ice dispensing device for delivering pieces of ice comprising;

a cutting member;

a container for containing ice and having an axial length from a first end of the container to a second end of the container; and a rotating threaded shaft extending in an axial direction through a space inside the container, wherein the container has a surrounding side wall having an inner surface extending substantially parallel to the axial direction of the container between the first end and the second end of the container, wherein the threaded shaft carries the cutting member for shaving the ice from a surface of the ice around the threaded shaft, wherein the container has a bottom wall at a lower side opposite to an upper side of the container where the cutting member is located, the threaded shaft is rotatably fixed in said bottom wall, and the container, after the water in the container is frozen, can be placed upside down in the ice dispensing device, and wherein the inner surface of the surrounding side wall of the container diverges over an axial length of the container along a direction of the cutting member to improve movability of the ice toward the cutting member.

19. The ice dispensing device as claimed in claim 18, wherein the bottom wall is provided with a valve in order to supply air into the container.

20. The ice dispensing device of claim 18, wherein said inner surface has a non-circular cross-section perpendicular to said axial direction.

21. The ice dispensing device of claim 18, wherein the cutting member is a disk-like element having a straight cutting edge extending in a radial direction with respect to the threaded shaft, a surface of the cutting member facing the ice being curved helically to correspond to a helical shape of the thread of the shaft, and wherein the cutting member has an opening in front of the cutting edge, the opening having a triangular shape.

* * * * *